US006062848A

United States Patent [19]

Lifshits

[11] Patent Number: 6,062,848

[45] Date of Patent: May 16, 2000

[54] VIBRATION-RESISTANT LOW $NO_X$ BURNER

[75] Inventor: Vladimir Lifshits, Redwood City, Calif.

[73] Assignee: Coen Company, Inc., Burlingame, Calif.

[21] Appl. No.: 09/087,426

[22] Filed: May 29, 1998

[51] Int. Cl.[7] ..... F23Q 9/00

[52] U.S. Cl. ..... 431/285; 431/178; 431/175; 431/181; 431/187; 431/116; 431/8; 431/12; 239/407; 239/428

[58] Field of Search ..... 431/285, 284, 431/283, 278, 280, 8, 178, 181, 179, 180, 187, 174, 175, 162, 12, 10, 281, 177, 115, 116, 190; 239/400, 407, 422, 428

[56] References Cited

U.S. PATENT DOCUMENTS

| | | | |
|---|---|---|---|
| 328,914 | 10/1885 | Ashcroft . | |
| 1,757,847 | 5/1930 | Shutt | 431/175 |
| 2,592,911 | 4/1952 | Ketelsen | 158/99 |
| 2,672,191 | 3/1954 | Campbell et al. | 431/178 |
| 3,285,315 | 11/1966 | Voorheis | 158/28 |
| 3,589,845 | 6/1971 | Morse | 431/285 |
| 4,416,615 | 11/1983 | Ketchum, Jr. | 431/285 |
| 4,439,137 | 3/1984 | Suzuki et al. | 431/8 |
| 4,496,306 | 1/1985 | Okigami et al. | 431/8 |
| 4,945,841 | 8/1990 | Nakamachi et al. | 431/178 |
| 4,971,552 | 11/1990 | Fukuda et al. | 431/351 |
| 5,067,419 | 11/1991 | Kobayashi et al. | 110/234 |
| 5,240,410 | 8/1993 | Yang et al. | 431/285 |
| 5,284,438 | 2/1994 | McGill et al. | 431/8 |
| 5,310,337 | 5/1994 | Lifshits et al. | 431/284 |
| 5,344,307 | 9/1994 | Schwartz et al. | 431/9 |
| 5,542,839 | 8/1996 | Kelly | 431/181 |
| 5,634,785 | 6/1997 | Bury et al. | 431/285 |
| 5,692,890 | 12/1997 | Graville | 431/9 |

*Primary Examiner*—Ira S. Lazarus
*Assistant Examiner*—Josiah C. Cocks
*Attorney, Agent, or Firm*—Townsend and Townsend and Crew

[57] ABSTRACT

A low $NO_x$ burner includes a refractory lined plate with a refractory side facing a combustion chamber. A multiplicity of combustion air passages extend through the plate toward the combustion chamber. A multiplicity of spaced-apart primary fuel nozzles each have a discharge opening being surrounded by one of the combustion air passages for directing fuel therethrough to mix with combustion air passing through the air passages. A multiplicity of anchor fuel nozzles project through the plate for directing fuel into the combustion chamber. The anchor fuel nozzles are spaced apart from each other and from the combustion air passages. The flows of fuel and combustion air through the primary and anchor nozzles and the air passages into the combustion chamber are controlled to generate a flame. In applications that require low excess air, such as boiler applications, the burner is modified by providing a secondary fuel and flue gas injection assembly to form a two-stage burner. In the preferred embodiment, the secondary injection assembly includes a plurality of discrete fuel and flue gas injection nozzles arranged around the primary and anchor fuel nozzles and combustion air passages. By varying the percentage and actual pattern of secondary fuel injection and by varying the configuration of the array of primary and anchor nozzles and the spacing between the nozzles, the flame shape may be easily tailored to the size and shape of practically any furnace. The flame can thus be optimized to achieve lower $NO_x$ and improved efficiency.

29 Claims, 6 Drawing Sheets

VIBRATION-RESISTANT LOW $NO_X$ BURNER

BACKGROUND OF THE INVENTION

In burners, $NO_x$ emissions rise exponentially with combustion temperature. These emissions typically are reduced by lowering combustion temperatures. In some cases this is accomplished by combusting the fuel with an increased amount of excess air (fuel-lean mixture), with the overall amount of combustion air substantially higher than the stoichiometric ratio. In other cases where low excess air is important for the efficiency of the operation, the emissions are reduced by fuel-staged combustion, with high excess air at the first stage and secondary fuel burning and consuming excess air downstream of the first stage.

One example of a system using excess air to reduce $NO_x$ emissions is disclosed in the article "The Development of a Natural Gas-Fired Combustor for Direct-Air" from the 1992 International Gas Research Conference. In this burner system, the fuel and gas are premixed and then injected in the combustion chamber. The air-fuel mixture is adjusted to provide whatever amount of excess air is desired to lower the temperature so that $NO_x$ emissions are minimized. One of the drawbacks of this system, however, is low turn-down and the danger of explosions upstream from the combustion chamber, for example in the burner.

In U.S. Pat. No. 5,102,329, a low $NO_x$ burner is disclosed, in which mixing of fuel gas and combustion air to the extent necessary for combustion in the burner is precluded. In this burner, fuel tubes or spuds are arranged over slots in a burner plate to discharge fuel gas therethrough at high velocities. Combustion air also is discharged from the burner through these slots. Although some mixing of fuel gas and combustion air (controlled exclusively by fuel gas jet entrainment of the combustion air) occurs along the boundary line between each cone-shaped fuel gas jet and the air, the space volume where this mixing occurs is negligible. In addition, the flow pattern in this area has a velocity component in the downstream direction that many times exceeds the propagation velocity of the flame. Accordingly, any flame flashback from the combustion chamber is mostly precluded and, if it occurs at extremely low loads, does not represent a danger for the burner operation.

Although the above systems advantageously reduce $NO_x$ emissions and, in the latter case, minimize the possibility of flame flashback, they are under certain conditions subject to combustion driven pulsation, which should be avoided. In burners generally, the combustion pulsations typically occur at a frequency of about 0.5–200 Hz due to the particular characteristics of the turbulence in the air supply, or numerous resonance modes of the system. It has been found that when heat of combustion is applied rapidly and uniformly to the mixture of fuel and air downstream of the burner in the area of combustion, it creates favorable conditions for the flame front to oscillate toward and away from the burner at a frequency determined by the system. This leads to vibrations, and causes resonance of the hardware of the furnace. These vibrations and resonance problems are of particular concern in large combustion devices.

U.S. Pat. No. 5,460,512 addresses these problems by providing a burner construction in which local oscillations of flame front generated in the combustion chamber are at different frequencies which are not synchronized, so that vibrations are greatly dampened and resonance problems in the furnace minimized or eliminated. The burner includes a burner plate having a plurality of slots from which fuel gas jets and combustion air are discharged. The slots are arranged such that the width of the recirculation zones between adjacent slots substantially varies between the central region of the burner plate and its perimeter. With this construction, the local ignition patterns vary such that local oscillations of flame front occur at different frequencies so that vibrations are greatly dampened and resonance problems in the furnace minimized or eliminated. In applications where high excess air is not desirable, such as boiler applications, the burner is modified by providing a secondary fuel and flue gas injection assembly to form a two-stage burner. The secondary injection assembly includes a plurality of discrete fuel and flue gas injection tubes arranged around the primary air and fuel gas discharge assembly. The secondary fuel is directed radially inward and downstream from the burner plate. At first the secondary fuel entrains partially cooled products of combustion surrounding the flame and then mixes with the remaining combustion air and burns in a secondary combustion zone. The resulting delay in the combustion of the secondary fuel gas and the involvement of partially cooled combustion products again in the combustion lowers peak combustion temperature, which in turn reduces the $NO_x$ formation in the second or downstream combustion zone.

The design of this kind of low $NO_x$ burner is dependent on a number of parameters, including target $NO_x$ emission level, types of fuels fired, furnace size, burner geometry, and cost. A particular burner for a specific application has a limited range of parameter variability for optimization. One of the most important limitations is the maximum size of the combustion device. There are several aspects in the known designs that limit its application, especially when very high heat inputs (typically over 100 million Btu per hour from a single device) are required. The first is a relatively large size of the device that sometimes makes it difficult to fit the burner within the available space at the front of the boiler. Second, a larger burner also requires a substantially larger air plenum at the front of the furnace that encompasses the burner body to provide proper air distribution across the burner. These wind boxes take up valuable real estate at the boiler front, often at the expense of boiler service area. Third, the flame generated by the burner is overall axially symmetrical. This creates a problem if the furnace is rectangular with a high aspect ratio and a high heat release per unit of furnace cross-section. Another limitation of the known design is the difficulty in accommodating firing of more than one gaseous fuel and one liquid fuel, as there is only one convenient location in the center of the burner for the liquid fuel gun.

SUMMARY OF THE INVENTION

The present invention is directed to a vibration-resistant low $NO_x$ burner that is more compact, versatile, and lower in cost than known combustion devices, especially in the range of high heat inputs of typically over 100 million Btu per hour.

According to the present invention, a burner is provided with a refractory lined plate having an array of air ports through which combustion air and primary fuel gas are introduced into a combustion chamber. The air ports are spaced by a distance of about 1.5 to 3 times the port discharge diameter and arranged in a substantially rectangular or oval array. The plate is mounted into a furnace front wall with the refractory facing the furnace and the opposite side of the plate facing the air plenum or wind box. Combustion air brought into the wind box discharges through the ports. The inlets of the air ports may be rounded, or they may be beveled in order to reduce air pressure losses at the port inlets and convert maximum pressure energy of the air flow to kinetic energy of the jets. A portion of fuel gas, referred to as primary gas, is injected into each air port through a nozzle, or a group of nozzles at the end of a gas line or primary gas spud located about the port centerline. The nozzles each have a single orifice or a group of orifices through which primary fuel is injected in a predominantly axial direction toward the furnace, and are located at a distance from the port exit, thereby providing additional distance for the mixing of primary fuel gas with air prior to its ignition in the furnace. The plate also has a plurality of additional small ports located in between the air ports. These ports provide passages for fuel gas lines or spuds, through which a small portion of the fuel gas, referred to as anchor gas, is injected directly into the furnace. The anchor gas is injected through a number of orifices provided at the end of each spud predominantly perpendicular to the plate. Another, optional series of ports is located around the periphery of the air ports array. These ports provide passages for another group of fuel gas lines or spuds, through which a remaining portion of fuel gas, referred to as secondary fuel gas, is injected into the furnace. The secondary fuel gas, delivered to each spud, is directed through a single or a number of orifices predominantly radially inward and downstream from the burner plate.

Generally each spud group is piped to a special header inside the wind box. Alternatively, all the spuds are connected to a common header.

If firing of liquid fuel(s) is also required, one or several ports in the center of the array may serve as passages for the guns that inject atomized liquid fuel into the furnace.

When burning gaseous fuels, the burner of this invention generates a very stable combustion. In the primary fuel-lean combustion zone adjacent to the plate, high combustion stability of the primary gas is achieved by recirculating flow created in the area between the air ports. The injection of the anchor gas directly into the recirculating area provides additional means of enhancing the combustion stability. The anchor fuel enriches the mixture in the recirculation zone between adjacent air discharge ports to the extent that creates close to stoichiometric conditions that maximize flame stability in this zone. Low $NO_x$ in the primary zone is achieved due to rapid mixing effect of primary fuel with combustion air in a fuel-lean environment when substantially uniform fuel-lean mixture is formed prior to the fuel ignition.

The optional secondary fuel gas at first entrains partially cooled products of combustion surrounding the flame and then mixes with the remaining combustion air and burns in a secondary combustion zone. The multiple jets of burning primary fuel gas and air also contribute to the entrainment of combustion products surrounding the flame back into the flame at an increased rate, as opposed to a single round jet. The involvement of partially cooled combustion products again in the combustion lowers peak combustion temperature, which in turn reduces the $NO_x$ formation in the secondary or downstream combustion zone.

The vibration resistance of the burner is achieved by creating a number of individual burning jets. In this arrangement oscillations in the flame fronts of the jets do not become synchronized due to a complex geometry of the recirculation area unfavorable to supporting any particular frequency.

In some applications of the burner, when lower $NO_x$ is required, the combustion air is mixed with a portion of the flue gas from the stack—the technique commonly known as the flue gas recirculation (FGR).

In a preferred embodiment the anchor fuel corresponds to about 2–15 percent of the total fuel gas. The amount of the fuel delivered through primary gas spuds varies widely depending on the required overall flame intensity or flame size, target $NO_x$ emission, combustion air temperature, and the amount of FGR. Typically, without the use of FGR the percentage of primary fuel gas necessary for low $NO_x$ operation of the burner varies from 40 percent to 60 percent of the overall fuel flow to the burner. The balance of the fuel gas is delivered through the secondary gas spuds. With the increased use of FGR, the percentage of primary fuel increases and that of the secondary fuel decreases. Depending on the on-line flexibility of the burner, turn-down requirements, etc., the primary, anchor, and secondary gas spuds may be piped to a single header, or to as many as three separate headers, respectively. The pattern of secondary fuel injection in general is such that the secondary fuel jets penetrate in between the jets of air and primary fuel, or products of its combustion. This, coupled with the intense turbulence created by all the high velocity jets, provides intense mixing of secondary fuel and air necessary to generate a compact flame. Furthermore, by varying the percentage and the actual pattern of secondary fuel injection and by varying the configuration of the multiple ports array and the spacing between the ports, the flame shape may be easily tailored to the size and shape of practically any furnace. The ability to perform this kind of optimization is beneficial for achieving lower $NO_x$ and maximum performance in a given system, and is a unique feature of the present burner.

These features are of particular importance to the design of larger burners with heat inputs of over 100 million Btu per hour. With conventional burners, many problems, such as flame stability and vibration, and insufficient flame intensity, are magnified when scaling up the burner. Large burners also require substantially larger air plenums at the front of the furnaces that have to encompass a larger burner body with a long refractory throat and be roomy enough to provide proper air distribution across the burner. These wind boxes take up valuable real estate at the boiler front, often at the expense of the boiler service area. The burner of the present invention has actually neither a body nor a throat. Due to the relatively small size of the air ports, a length-to-diameter ratio, typically more than 1.5 to 1, is achieved within the thickness of the refractory covering the plate. This gives good directionality to the flow, without taking an additional space inside the wind box. At the same time a good uniformity of air distribution between the ports can be achieved with very shallow wind boxes, as the passage for air flow within the wind box is practically unobstructed. If lower refractory thickness is appropriate for the protection of the plate from the heat in the furnace, the ports might be extended from the plate into the wind box in order to achieve the desired length-to-diameter ratio.

Other features, advantages and embodiments of the invention will be apparent to those skilled in the art from the following description, accompanying drawings, and appended claims.

BRIEF DESCRIPTION OF THE DRAWINGS

The preferred embodiments of this invention, illustrating all their features, will now be discussed in detail. These embodiments depict the novel and nonobvious burner of this invention shown in the accompanying drawings, which are included for illustrative purposes only. These drawings include the following figures, with like numerals indicating like parts.

DETAILED DESCRIPTION OF THE INVENTION

Figure 1:
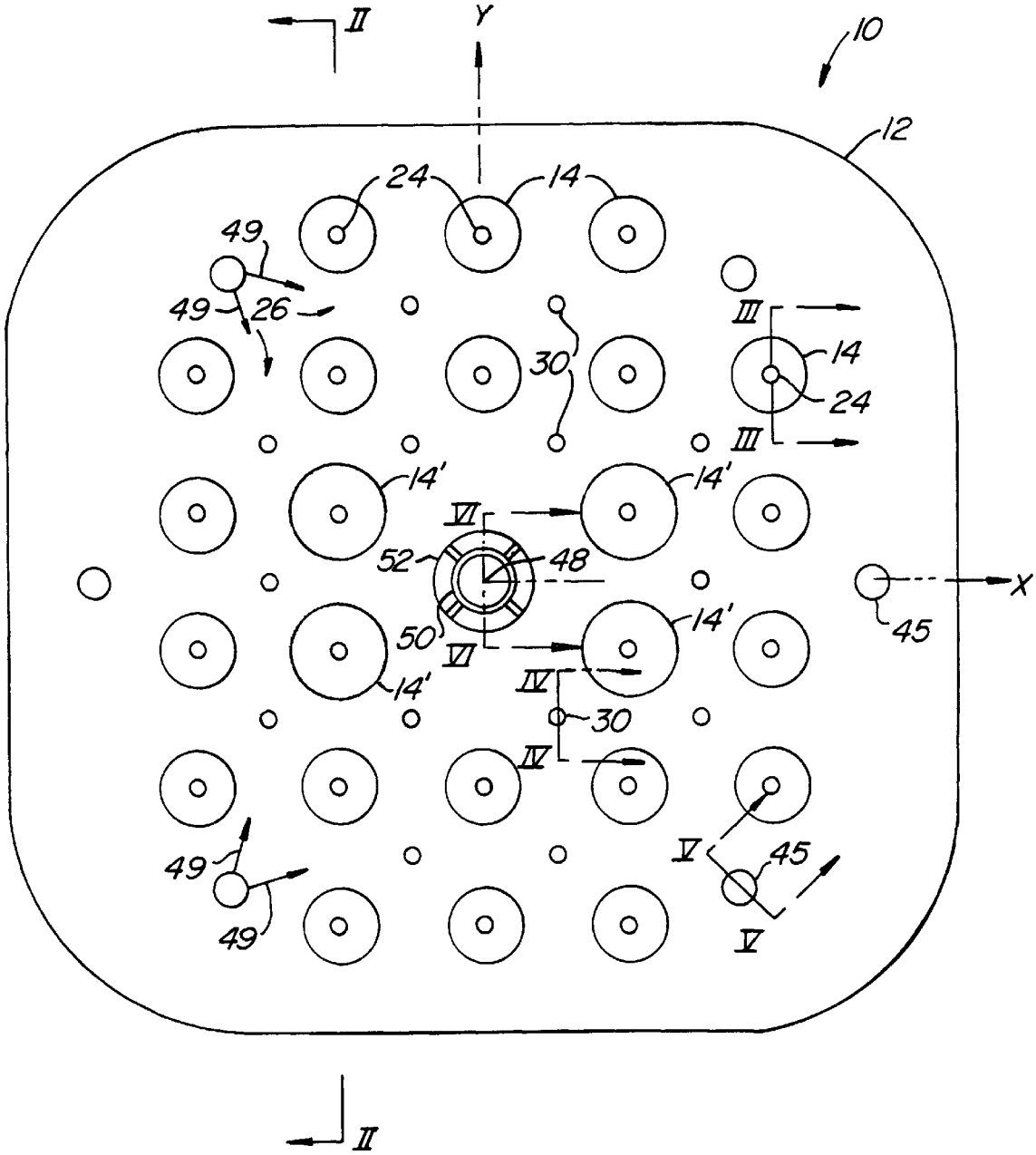
FIG. 1 is a front view (I—I) of a burner in accordance with an embodiment of the present invention.
Figure 2:
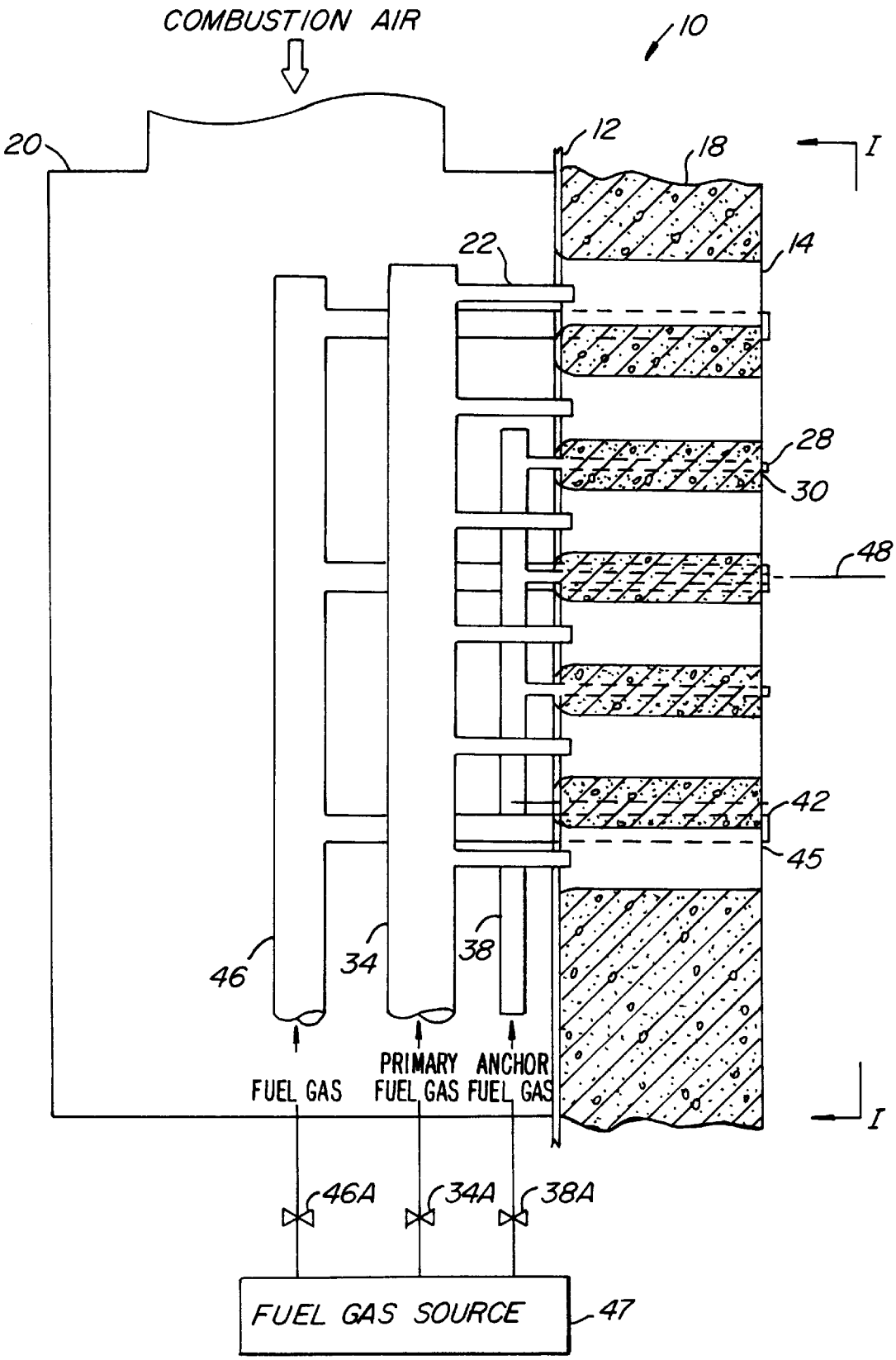
FIG. 2 is a sectional view of the burner of FIG. 1 along II—II.

FIGS. 1 and 2 show a burner 10 in accordance with the principles of the present invention. The burner 10 generally comprises a plate 12 with air ports 14 through which streams of combustion air, or a mixture of air and FGR, pass to a combustion chamber downstream from the plate 12. The surface of the burner plate 12 facing the combustion chamber is protected from the heat in the furnace with a refractory material 18. The inlets of the air ports 14 are typically flared or beveled.

A conventional wind box 20 provides the housing for the combustion air or mixture of combustion air and FGR. The wind box 20 is connected to an air supply, and houses other conventional components of the burner 10 (not shown). These components provide functions such as flame ignition and flame scanning, and include mounting hardware for different components, including a liquid fuel gun (if required), conventional door assembly for mounting and service access to the interior of the burner 10, etc.

The centerlines of the air ports 14 are typically spaced about 1.5 to 3 times the average port diameter. The number of air ports 14, their size, and the overall arrangement may vary widely depending on the specifics of a particular system. The number of air ports 14 typically varies from 6 to 30. The diameter of the air port 14 is typically in the range from about 3 to 12 inches (about 75–300 mm). The sum of air port cross-section is determined based on the required maximum amount of flow passing through the burner 10 (which is proportional to its capacity) and the desired or available differential pressure between the wind box 20 and the furnace 10. In low pressure systems this differential pressure at high fire is typically in the range from about 2 to 10 inches (about 50–250 mm) of water column.

Figure 3:
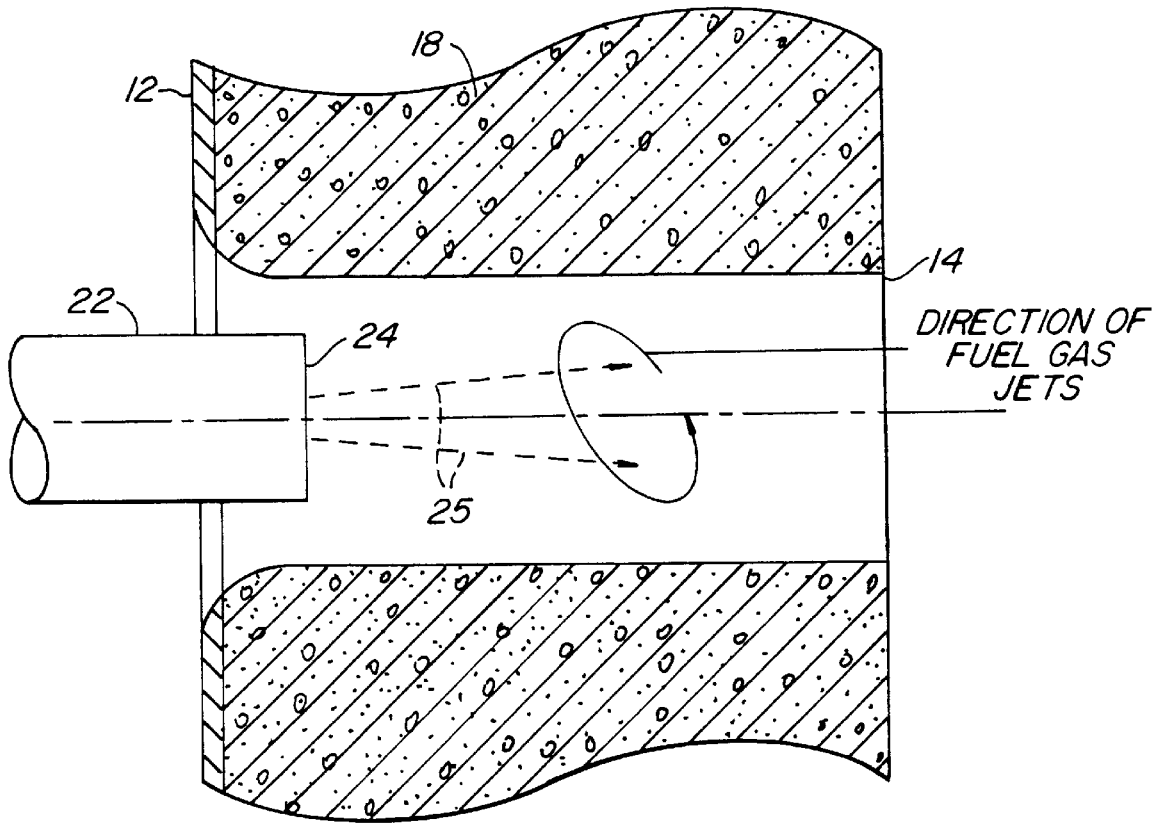
FIG. 3 is a sectional view of the burner of FIG. 1 along III—III schematically illustrating an air discharge port and a primary fuel gas spud with the primary fuel gas jets.

A plurality of fuel gas spuds protrude through the plate 12. A first set of spuds includes primary fuel gas spuds 22 centered relative to the air ports 14, as best seen in FIGS. 1–3. The ends of primary nozzles 24 of primary spuds 22 directed to the furnace have typically from 1 to 6 orifices through which primary fuel gas is discharged into the air flow predominantly in the axial direction of the air ports 14 toward the furnace as indicated by arrows 25. For the purposes of good fuel gas distribution and mixing, the primary spud end 24 is inserted into the port 14 by at least 0.25 times the air port diameter. The combustion recirculation zones formed between adjacent air discharge ports 14 on the outer surface of the refractory material 18 on the burner plate 12 are generally designated with reference numeral 26.

The refractory material 18 covering the plate 12 has a certain thickness, typically ranging from about 6 to 14 inches. The minimum thickness of the material 18 depends on its thermal conductivity, temperature of the flow inside the wind box 20, and the limitations on the temperature of the plate 12. However, it is convenient from the design standpoint to have it over 1.5 times the air port diameter. If lower thickness of the refractory material 18 is desired, the air ports 14 may be extended toward the wind box 20 in order to maintain a proper distance from the primary spud nozzles 24 to the discharge end of the air ports 14.

Figure 4:
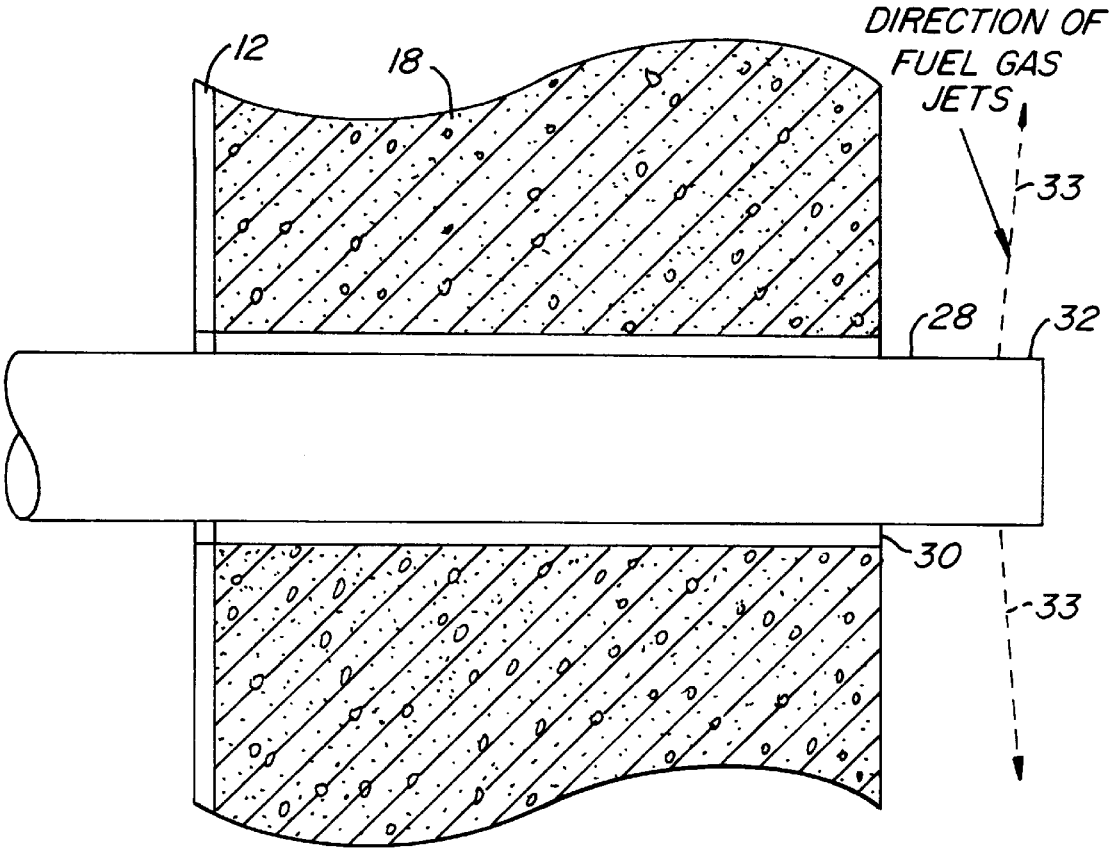
FIG. 4 is a sectional view of the burner of FIG. 1 along IV—IV schematically illustrating an anchor fuel gas spud with the anchor fuel gas jets.

Referring to FIGS. 1, 2 and 4, a second set of fuel gas spuds are discrete anchor fuel spuds 28 disposed at anchor fuel ports 30 of the burner plate 12. The anchor openings 30 are spaced apart from one another and from the air discharge ports 14 and located near the center in between the adjacent air ports 14. The anchor spuds 28 extend through the anchor openings 30 of the burner plate 12 and the refractory material 18. The discharge end of each anchor fuel gas spud 28 has a nozzle 32 with typically 2 to 6 orifices designed to inject anchor gas fuel predominantly in the direction perpendicular to the plate 12 as denoted by arrows 33. This pattern of injection enhances the recirculation due to the laws of fluid dynamics. The primary and anchor fuel gas spuds 22, 28 receive gas respectively from primary and anchor fuel gas supply manifolds 34, 38. The fuel gas supply lines 34, 38 are adapted to be coupled to a fuel supply source (not shown). The primary fuel manifold and anchor fuel manifold are connected, by conventional control valves, to a pressurized fuel gas source supply. Separate manifolds are preferred for very high turn-down, low $NO_x$ emission, and optimization for different load Levels, although a single manifold can be used to distribute fuel gas to the primary and anchor fuel gas assemblies. The distribution of the primary nozzles 24 and anchor openings 30 is shown in FIG. 1.

Typically all the air ports 14 are of the same size. However, one or several air ports 14 in the center of the array may be of a different diameter to accommodate specific requirements of liquid fuel atomizer(s). The location of the primary fuel gas spuds 22 at the air ports 14 designated for the atomizers will then be changed to avoid the interference with the atomizers, or, if those ports are relatively small, they may be provided without the primary gas spuds 22. If liquid fuel firing is required, the anchor openings 30 in the plate and refractory material 18 through which anchor fuel gas spuds 28 are introduced will be bigger than the anchor spuds 28. This is to allow a slight amount of combustion air to pass along the anchor spuds 28 for the purpose of spud cooling when firing liquid fuel.

Figure 5:
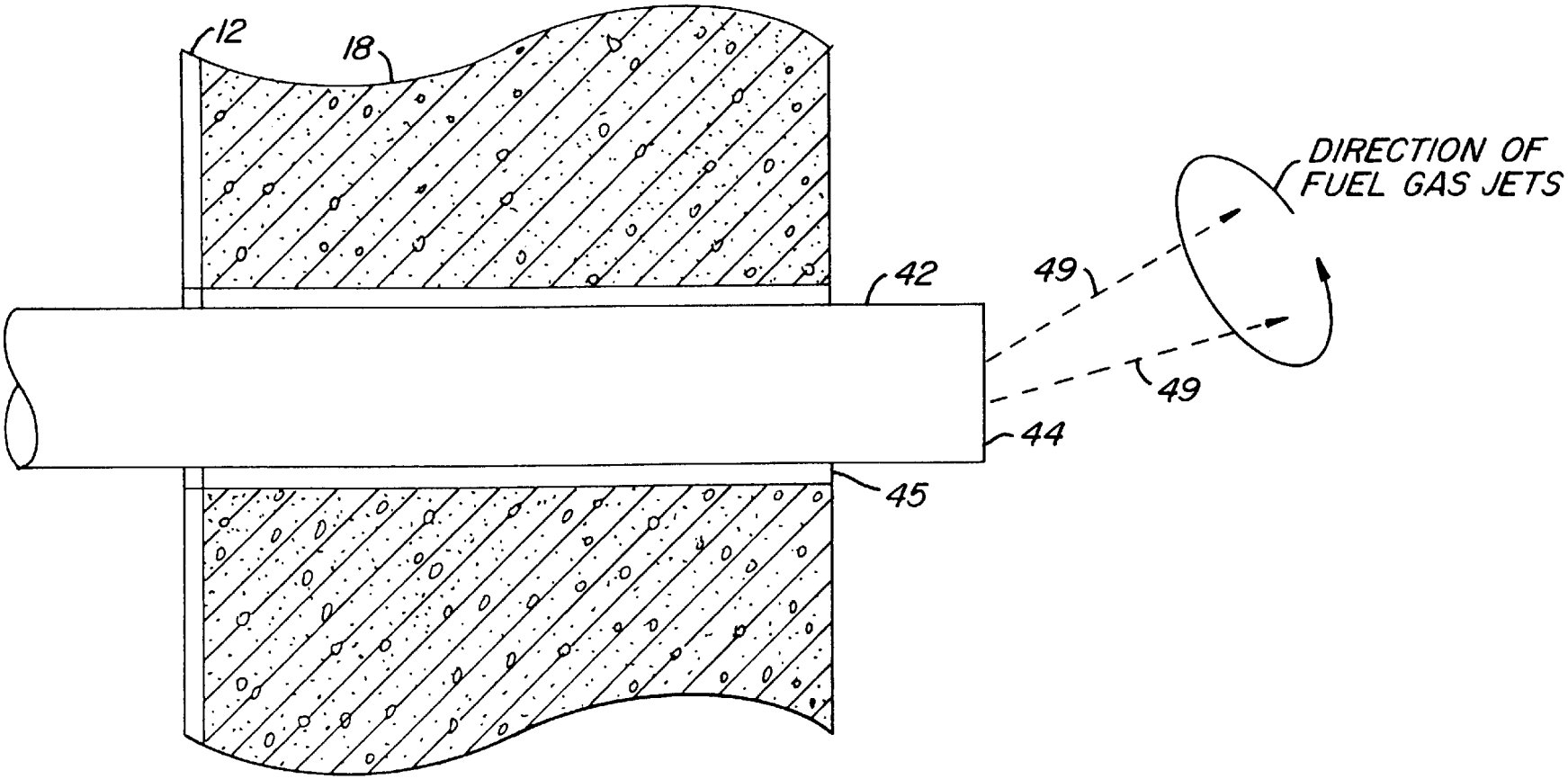
FIG. 5 is a sectional view of the burner of FIG. 1 along V—V schematically illustrating a secondary fuel gas spud with the secondary fuel gas jets.

For applications such as boilers where high amounts of excess air or FGR used for $No_x$ control purposes can reduce the efficiency of the boiler system, the total amount of excess air or FGR can be reduced by means of secondary fuel injection. FIGS. 1, 2 and 5 show a secondary fuel gas assembly for generating a two-stage combustion flame. The secondary injection assembly includes a plurality of secondary fuel gas injection tubes 42 having nozzles 44 arranged at secondary ports 45 around the array of primary nozzles 24 and air ports 14. Each secondary fuel gas injection tube or spud 42 is fluidly coupled to a secondary fuel gas manifold 46. The secondary fuel is directed radially inward and downstream from the burner plate 12. The nozzles 44 at the discharge end of each injector 42 are oriented for directing the fuel gas with compound angles in between the ports and toward centerline 48 of the burner plate 12 as shown with reference arrow 49 in FIG. 5. At first the secondary fuel entrains partially cooled products of combustion surrounding the flame and then mixes with the remaining combustion air and burns in a secondary combustion zone. The resulting delay in the combustion of the secondary fuel gas and the involvement of partially cooled combustion products again in the combustion lower peak combustion temperature, which in turn reduces the $NO_x$ formation in the second or downstream combustion zone.

The secondary fuel manifold 46, primary fuel manifold 34, and anchor fuel manifold 38 are connected, by conventional control valves 46A, 34A, 38A, to a pressurized fuel gas source supply 47. Separate manifolds are preferred for very high turn-down, low $NO_x$ emission, and optimization for different load levels. A single manifold can be used to distribute fuel gas to the primary, anchor, and secondary fuel gas assemblies, and provides a simpler structure.

Figure 6:
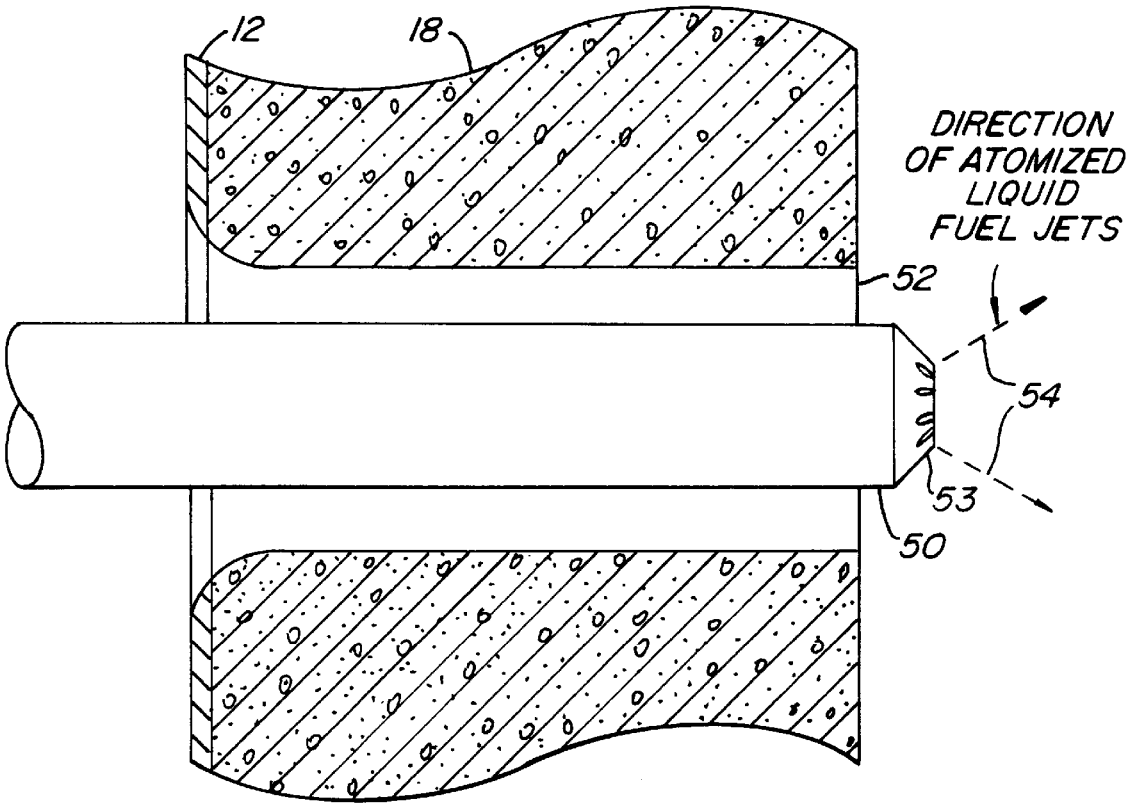
FIG. 6 is a sectional view of the burner of FIG. 1 along VI—VI schematically illustrating a liquid fuel atomizer port.

Burner assembly 10 also can be readily modified for use with single or multiple liquid fuels, like oil in combination with fuel gas, or in place of fuel gas. Because of the existence of multiple ports, the modification can be made more easily than in previous configurations. As shown in FIGS. 1, 2 and 6, a liquid fuel atomizer 50 can be supported through a port such as 52 located at the center 48 of the array. The liquid fuel atomizer 50 includes a discharge end 53 with a plurality of orifices for injecting liquid fuel illustrated by arrows 54. Multiple atomizers may be provided through multiple ports (not shown). Further, the multiple port configuration of the present invention can also be readily modified to provide a multiple fuel system (multiple gaseous and liquid fuels).

In operation, an anchor fuel burns inside the recirculation area 26 together with a portion of primary fuel delivered into the recirculation area by mixing between the recirculating flow and flow immediately discharging through the anchor openings 30. With the proper amount of injection of anchor fuel gas, the flame in the recirculation area 26 is very stable and provides a continuous pilot flame for the ignition of a typically fuel-lean mixture of combustion air and primary gas fuel, or a mixture of combustion air FGR and primary gas fuel after it discharges through the air ports 14. In addition, although FIG. 1 shows anchor openings 30 that are interspersed within the array of air ports 14 and each surrounded by four adjacent air ports 14 with primary nozzles 24, other arrangements are possible. For instance, some of the anchor openings 30 may be disposed outside and surround the array of air ports 14. In this case the peripheral anchor spuds will inject fuel predominantly to the center of the ports array.

The fuel gas from the primary fuel gas nozzles 24 and anchor fuel gas nozzles 32, together with the air from the air discharge ports 14, form a single flame which can be monitored by as few as one flame scanner aimed through a proper port. The individual spuds are not intended to operate independently as the flame in the recirculation area 26 couples a large number of jets of primary fuel gas and combustion air. At the same time, some peripheral jets of primary fuel gas and combustion air may ignite not from the recirculation area 26, but with some delay from the hot combustion products of other jets, that are typically closer to the center 48 of the array.

In the embodiment shown in FIGS. 1 and 2, the distribution of the primary spuds 22 and anchor spuds 28 is not symmetrical with respect to the centerline 48 of the burner plate 12, but is symmetrical relative to the X-axis and Y-axis. Other symmetrical and non-symmetrical distributions can be used. The primary nozzles 24 in FIGS. 1 and 2 have similar sizes. The sizes of the primary nozzles 24 may be varied and nonuniform in order to achieve a certain flame shape, if required. Likewise, the anchor nozzles 32 may be generally uniform or nonuniform in size. In addition, the number of the primary spuds 22 and anchor spuds 28 may be varied. Although the burner plate 12 is illustrated as being substantially oval, it can have other configurations without departing from the scope of the present invention.

Referring to FIG. 3, the primary nozzles 24 are preferably centered or aligned relative to the air discharge ports 14 for substantially uniformly mixing primary fuel gas and air inside the ports 14 prior to discharging into the combustion chamber. Otherwise, the primary fuel gas would be distributed unevenly across the air flow, resulting in decreased burner performance and increased $NO_x$ production. However, other arrangements, resulting in the substantially uniform distribution of primary gas at the port discharge, are possible.

The primary nozzles 24 could be axially inserted into the air discharge ports 14 of the burner plate 12 closer to the outer surface of the refractory material 18, to avoid fuel gas deflection. Such an arrangement, however, would result in the mixing of the primary fuel gas with combustion air to occur mostly downstream of the burner plate 12 where there is high turbulence. In that case, a portion of the fuel can burn before mixing with a sufficient amount of air, resulting in increased $NO_x$ emissions. It would also cause some additional delay in ignition from the moment fuel gas and combustion air exit the burner plate 12. This delay is undesirable, as it affects the stability of the combustion.

The distance between the air discharge ports 14 can influence flame intensity. In the preferred embodiment, this distance falls within the range of about 1.5 to 3 times the diameter of the air discharge port 14. When the air discharge ports 14 are too close to one another, the size of the recirculation zones 26 between the ports 14 and the residence time of the fuel gas-air mixtures when passing between recirculation zones 26 are reduced to the extent that flame blowout results, while the load is below the desirable level. In other words, the period in which this fuel gas-air mixture remains in the recirculation zone 26 is insufficient to produce combustion and thus supply the recirculation zones 26 with hot combustion products which sustain ignition. On the other hand, when adjacent air discharge ports 14 are spaced too far apart, flame intensity significantly decreases with the decreasing amount of fuel and air per unit of burner cross-section, which generally is not desirable, especially for large burners. The other related problems are reduced turndown and delayed ignition of the burner, that may create safety concerns. With the distance between the ports within the specified range there is intense mass exchange between different parts of the recirculation zone 26, so that burner 10 ignites almost immediately from the ignitor flame discharging through one of the ports in the middle of the array.

A feature of the construction illustrated in FIGS. 1 and 2 is that with a sufficient amount of excess air, the burner generates very low $NO_x$. This results from mixing of fuel with all of the air delivered to the combustion chamber from the burner 10 prior to ignition, thus mostly avoiding hot spots within the flame that are associated with combustion of mixtures close to stoichiometric proportions. Specifically, the fuel gas is first ignited at a point where it is mixed with enough excess air so that the combustion temperature does not become too high, thereby limiting the $NO_x$ production. This is done by a combination of steps: preventing an immediate ignition of the primary fuel gas inside the primary ports as it exits from the nozzles 24 by enveloping the gas with air along the distance from the primary nozzles 24 to the air ports 14 at the surface of the refractory material 18 and, then, inducing turbulence, which is accomplished by discharging the gas and air at high speeds. As the gas stream travels downstream, it typically expands in a cone shape and increasingly mixes with air which flows along its margin and with recirculating hot gases. Under these conditions, ignition starts from the periphery of the cone-shaped jets discharging from the primary nozzles 24, and propagates by turbulent mixing to the jet centers. The local concentration of fuel on the jet periphery, where the ignition starts, is close to lean flammability limit. Additional time, required for flame propagation to the jet centers, adds to the mixing prior to ignition and allows averaging of fuel concentration in the combustion air. Thus, combustion in the primary zone downstream from the burner plate 12 occurs mostly at fuel-lean conditions with high excess air or FGR, limiting combustion temperature and minimizing $NO_x$ production. In the recirculation areas in between the ports, the concentration of fuel and oxygen is typically close to stoichiometric, which enhances the stability of the flame.

The same burner generates very low $NO_x$ when operating at low excess air mixed with a sufficient amount of FGR. This results from mostly avoiding spots within the flame associated with combustion of mixtures at substoichiometric conditions primarily responsible for so-called "PROMPT" $NO_x$. In the test firings, emissions as low as 7 ppm $NO_x$ corresponding to 3 percent $O_2$ in the flue gas were achieved.

Low $NO_x$ burners incorporating uniform mixing of fuel with air prior to ignition as described above are known, but it has been found that the flame front generated with those systems has the propensity to oscillate, if the amounts of excess air or FGR deviate from the required levels, determined with narrow margins. When pulsations in the heat energy release become synchronized with one of the resonance frequencies, amplification of the flame front pulsation occurs that in its turn results in substantial pressure pulsation in the furnace and in the air passages, which leads to strong vibrations of the hardware of the furnace.

The undesirable vibration and resonance effects described above greatly diminish in the burner 10 of the present invention because the mixture of air and primary fuel enters the combustion volume as a number of discrete relatively small jets through discharge ports 14. This arrangement affects the configuration of the recirculation zones 26, as discussed in more detail below, so that local oscillations of flame front occur at different frequencies and are not synchronized. As a result, vibrations are greatly dampened and resonance problems essentially do not occur.

Another feature of the burner 10 configured as shown in FIGS. 1 and 2 is that the large number of ports can achieve a substantial flame capacity with a relatively small area of the burner plate 12. At a given pressure drop across the plate 12, the multiple ports allow a higher volume of air flow and FGR delivered through the burner plate 12 into the furnace than some of the previous burners. The high turbulence created in the area where flow through ports 14 enters the furnace produces a more compact and intense flame for a given plate area. By the same token, a more compact burner plate 12 can be used to produce a flame of a given capacity. This feature is of particular importance in the design of larger burners having higher capacities. Many problems are magnified when scaling up a burner, such as flame stability and vibration. Ocher components such as the wind box 20 will need to be enlarged. The compact arrangement in accordance with the present design can alleviate and minimize these problems, and reduce cost of the burner 10. In addition, the compact arrangement is even more advantageous if the available space limits the overall size of the burner that can be built.

The multiple port configuration makes it easier to generate the flame of any desired shape, determined by the geometry of the furnace. FIGS. 1 and 2 show a substantially oval burner plate 12. Similar arrangements of the ports can be used for a circular plate or a plate of other shapes. The multiple port configuration is more flexible and better suited to a variety of furnace geometries.

In the present design, each individual port or opening has a relatively small size, especially if the number of ports is large. This makes it easier to provide a large length-to-diameter ratio of each port that results in improved directionality of the air flow through the air ports 14. That is, the air flow tends to be more straight and uniform in the same direction across the burner plate 12. The uniform air flow improves the performance of the burner 10. Burners with a smaller length-to-diameter ratio typically do not perform as well because the air flow has more room to change direction while passing through the burner. This improvement in the aspect ratio is of particular significance if the wind box is shallow.

Increasing the number of discrete primary nozzles 24 and corresponding air discharge ports 14 and the number of discrete anchor nozzles 32 reduces oscillations in the flame. On the other hand, increasing the number of these ports raises cost and is more likely to degrade the structural integrity of the refractory 18. In addition, there is generally a diminishing return of benefits after the number of ports reaches a certain level. In the embodiment shown, a practical range of the number of ports 24 is about six to thirty. In general, there is no practical need to go beyond thirty ports 14. In designing and selecting the number of ports, the primary factors to consider include: combustion stability, which is related to the residence time of gas inside the recirculation zone; cost, which generally increases with the number of ports; length-to-diameter ratio of the port, which affects the uniformity of air and fuel distribution and pressure losses through the burner; ability of the secondary fuel gas jets to penetrate in between the jets discharging through the ports, which to some degree affects flame size and $NO_x$ production; and flame size and shape, which is related to the overall arrangement of ports 14 and their size.

It has been found that with the combined arrangement of the primary nozzles 24 and anchor nozzles 32, enhanced flame stability results. That is, flame blow-out is not a concern up to about 110 percent excess air, or with up to about 30 percent of FGR if the burner 10 operates with low excess air. One advantage of this relatively wide range is that it reduces the requirements to the control system controlling the fuel-to-air ratio and, if present, the percentage of FGR since the ratios are less critical in view of the relatively wide range noted above.

Referring to FIGS. 1–4, the operation of the burner 10 with only the primary spuds 22 and anchor spuds 28 is described as follows. Fuel gas is discharged at a high speed through primary nozzles 24. At full load the fuel gas exits the primary nozzles 24 typically at 200–400 m/s in the direction of the air ports 14 in the burner plate 12. Combustion air flows through the air discharge ports 14 at a velocity at full load of about 30–50 m/s. This high fuel gas and combustion air velocities generate high turbulence in the combustion chamber so that the desired intensity flame is achieved. The jet of primary fuel gas, combustion air and FGR (if present) exiting the air port 14 is typically cone-shaped. A flame front is initiated at a point downstream from the burner plate 12 where a sufficient amount of recirculating hot gases penetrates into the jet, supplying energy for ignition of primary fuel gas.

The resultant flame is anchored to burner plate refractory 18. Marginal eddy currents of the recirculation gases are formed in the recirculation zones 26. Since the width of the recirculation zone 26 between adjacent round ports 14 varies, the local ignition patterns also vary. As a result, local oscillations of flame front occur at different frequencies and are not synchronized. In this way, oscillations are greatly dampened and resonance problems are minimized or eliminated. The shape of the air discharge ports 14 may vary to some degree, but the round shape is preferred due to its simplicity.

For low $NO_x$ combustion, a substantial portion of fuel is injected through the primary nozzles 24. The exact portion depends on numerous factors such as the desired flame size, $NO_x$ emission level, the amount of FGR, etc. These factors need to be optimized for particular applications. In general, the percentages of fuel discharged fall within the following ranges: about 2 to 15 percent for anchor fuel gas nozzles 32, and about 85 to 98 percent for primary nozzles 24.

Merely to exemplify the makeup of a burner that was tested and provided the foregoing results, the following example is recited. This example is given for purposes of illustration, and is not intended to limit the scope of this invention. The burner plate 12 has a length of 48 inches and a width of 40 inches with rounded corners to form a substantially oval shape. The port 52 at the center has a diameter of 6 inches, and is equipped with the support for a liquid fuel gun, while the air ports 14 have a diameter of 4 inches. Adjacent air discharge ports 14 are spaced from each other by about 8 inches. The anchor spuds 28 include anchor nozzles 32 that direct the anchor fuel therethrough in directions generally transverse to the direction of the primary fuel. The burner 10 includes a total of twenty-four primary fuel nozzles 24 and corresponding air discharge ports 14, and fourteen anchor fuel ports 30 interspersed between the air ports 14, as illustrated in FIG. 1. The amount of air discharging through ports 14 corresponds to as high as 80 percent of excess air, or lower excess air, if mixed with some amount of FGR. The anchor fuel enriches the primary fuel-air mixture in the recirculation zone 26 to create substantially stoichiometric conditions. These parameters are especially appropriate for air heaters.

The addition of the secondary fuel spuds 42 generates a two-stage combustion flame, which is described in connection with FIGS. 1–5. By angling the gas stream discharged from the secondary fuel nozzles 44 with compound angles toward predominantly the centerline 48 of the burner plate 12 in between the ports seen on FIG. 1 and substantially downstream into the combustion chamber, two combustion zones can be generated, as the fuel gas from nozzle 44 combusts at some distance downstream of the burner plate 12, i.e. in a secondary combustion zone. The angles at which secondary fuel is injected depend on the particular burner, and an example is shown by arrows 49 in FIGS. 1 and 5.

The mixing of the secondary fuel with air is intense, because the secondary fuel penetrates easily into the main flame when injected in between the round streams discharging through the ports 14. The resulting flame is compact and has a high intensity.

The exact portion of fuel injected through the different groups of nozzles 24, 32 and 44 depends on numerous factors, such as the desired flame size and $NO_x$ emission level, as well as the amount of FGR used for additional $NO_x$ control purposes. The higher the percentage of fuel injected through the primary nozzles 24, the more compact is the flame. Increasing the percentage of primary fuel gas typically above 50–60 percent increases $NO_x$, that however might be reduced by mixing combustion air with FGR. The maximum amount of FGR that can be mixed with air without creating combustion instability increases with the increase in the percentage of primary fuel gas. These factors need to be optimized for particular applications. In general, the percentages of fuel discharged by the three types of fuel ports fall within the following ranges: about 2 to 15 percent for anchor nozzles 32, about 40 to 95 percent for primary nozzles 24, and about 0 to 55 percent for secondary nozzles 44.

The above is a detailed description of a preferred embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. A burner comprising:

a burner plate;

a multiplicity of combustion air ports extending through the plate toward a combustion chamber;

a multiplicity of spaced-apart first fuel nozzles each surrounded by one of the combustion air ports for directing fuel gas therethrough to the combustion chamber;

a multiplicity of second fuel nozzles projecting through the plate toward the combustion chamber and being spaced apart from each other and from the combustion air ports for directing fuel therethrough to the combustion chamber; and means for controlling the flows of fuel and combustion air through the first and second nozzles and the combustion air ports in concert with each other into the combustion chamber to generate a flame, wherein the second fuel nozzles are coupled to a fuel source for discharging fuel into the combustion chamber constituting about 2 to about 15 percent of a total amount of fuel flowing through all fuel nozzles of the burner into the combustion chamber.

2. The burner of claim 1, wherein the first nozzles and combustion air ports direct fuel and combustion air in a downstream direction toward the combustion chamber and the second nozzles direct fuel flows generally transverse to the downstream direction.

3. The burner of claim 1, wherein the combustion air ports are substantially round.

4. The burner of claim 3, wherein each pair of adjacent combustion air ports have centers which are spaced by a distance ranging from about 1.5 to about 3 times an average diameter of the pair of adjacent combustion air ports.

5. The burner of claim 1, further comprising means for providing fuel to the first and second fuel nozzles such that the fuel is discharged from the nozzles at velocities sufficient to generate intense mixing with the combustion air flowing through the combustion air ports.

6. The burner of claim 1, further comprising means for discharging combustion air through the combustion air ports.

7. The burner of claim 1, wherein the combustion air ports are nonuniform in size.

8. The burner of claim 1, wherein the second fuel nozzles are interspersed between the combustion air ports.

9. The burner of claim 1, further comprising a plurality of third fuel nozzles spaced around a periphery of the first and second fuel nozzles for directing fuel therethrough to the combustion chamber.

10. The burner of claim 9, wherein said plurality of third fuel nozzles are provided for directing fuel with compound angles substantially downstream into the combustion chamber and substantially toward a centerline of the burner plate extending perpendicular therefrom in the combustion chamber.

11. A burner comprising:

a burner plate having a plurality of spaced combustion air ports and spaced anchor ports formed therethrough for introducing air and fuel gas into a combustion chamber the anchor ports being spaced from the air ports; and a multiplicity of primary fuel nozzles and anchor fuel nozzles adapted to be coupled to a fuel source, where each primary fuel nozzle is aligned with one of the combustion air ports for substantially uniformly mixing primary fuel gas and air inside the combustion air port prior to discharging into the combustion chamber, each anchor fuel nozzle extending through one of the anchor ports for directing anchor fuel gas into the combustion chamber, wherein the anchor fuel gas constitutes a percentage of a total fuel gas supplied to the burner ranging from about 2 to about 15 percent.

12. The burner of claim 11, wherein the combustion air ports are substantially round.

13. The burner of claim 12, wherein each pair of adjacent combustion air ports have centers which are spaced by a distance ranging from about 1.5 to about 3 times an average diameter of the pair of adjacent combustion air ports.

14. A burner comprising:

a burner plate having a plurality of spaced air ports and spaced anchor ports formed therethrough for introducing air and fuel gas into a combustion chamber, the air ports being substantially round, each pair of adjacent air ports having centers which are spaced by a distance ranging from about 1.5 to about 3 times an average diameter of the pair of adjacent air ports, the anchor ports being spaced from the air ports; and a multiplicity of primary fuel nozzles and anchor fuel nozzles adapted to be coupled to a fuel source, each primary fuel nozzle being aligned with one of the air ports for substantially uniformly mixing primary fuel gas therethrough with air inside the air port prior to discharging into the combustion chamber, each anchor fuel nozzle extending through one of the anchor ports for directing anchor fuel gas into the combustor chamber, wherein the anchor fuel directed into the combustion chamber constitutes about 2 to about 15 percent of a total amount of fuel flowing through the burner plate into the combustion chamber.

15. The burner of claim 14, further comprising means for providing fuel to the primary and anchor fuel nozzles such that the fuel is discharged from the nozzles at velocities sufficient to generate intense mixing with the air inside the air ports downstream from the burner plate.

16. The burner of claim 14, wherein the air ports are distributed over a substantially oval area of the burner plate.

17. The burner of claim 14, wherein the number of the air ports ranges from about six to about thirty.

18. The burner of claim 14, wherein the primary fuel nozzles and air ports direct air and primary fuel gas in a downstream direction toward the combustion chamber and the anchor fuel nozzles direct anchor fuel gas flows generally transverse to the downstream direction.

19. The burner of claim 14, further comprising a plurality of secondary fuel nozzles extending through secondary ports formed through the burner plate and spaced around a periphery of the air ports and anchor ports for directing secondary fuel gas into the combustion chamber.

20. The burner of claim 14, wherein the plurality of secondary fuel nozzles are provided for directing secondary fuel gas with compound angles substantially downstream into the combustion chamber and substantially toward a centerline of the burner plate extending perpendicular therefrom in the combustion chamber.

21. The burner of claim 14, wherein the burner plate is lined with a refractory facing the combustion chamber and having a thickness for protecting the burner plate from heat in the combustion chamber.

22. The burner of claim 21, wherein the thickness of the refractory is about 6 to about 14 inches.

23. The burner of claim 14, wherein the spaced air ports each have a length-to-diameter ratio of at least about 1.5.

24. A method of providing low $NO_x$ combustion comprising the steps of:

introducing a multiplicity of spaced primary flows of a mixture of fuel gas and air into a combustion chamber to form recirculation areas between the spaced primary flows;

introducing a multiplicity of spaced anchor flows of an anchor fuel gas between the primary flows into the recirculation areas in the combustion chamber, wherein the anchor fuel gas constitutes a percentage of a total fuel gas introduced into the combustion chamber ranging from about 2 to about 15 percent;

controlling the multiplicity of primary flows of the mixture and multiplicity of anchor flows of the anchor fuel gas in concert with each other; and combusting the mixture of fuel gas and air and anchor fuel gas to generate a flame in the combustion chamber.

25. The method of claim 24 wherein the multiplicity of primary flows and multiplicity of anchor flows are introduced in close proximity to each other.

26. The method of claim 24 wherein the multiplicity of primary flows are directed in a downstream direction and the multiplicity of anchor flows are directed generally transverse to the downstream direction.

27. The method of claim 24 further comprising the step of introducing into the combustion chamber a multiplicity of secondary flows of a secondary fuel gas which are spaced around a periphery of the spaced primary flows and spaced anchor flows.

28. The method of claim 27 wherein the multiplicity of secondary flows are directed with compound angles substantially downstream into the combustion chambers and substantially toward a centerline extending downstream from a central area of the spaced primary flows.

29. The method of claim 24 wherein the spaced primary flows are introduced with substantially round cross sections and each pair of adjacent primary flows have centers which are spaced by a distance ranging from about 1.5 to about 3 times an average diameter of the pair of adjacent primary flows.

* * * * *